US005655815A

United States Patent [19]

Lohmeyer

[11] Patent Number: 5,655,815

[45] Date of Patent: Aug. 12, 1997

[54] ONE-PIECE FURNITURE FRAME

[76] Inventor: Hartmut Lohmeyer, Flemingstrasse 94a, D-81925, Munchen, Germany

[21] Appl. No.: 588,086

[22] Filed: Jan. 18, 1996

[30] Foreign Application Priority Data

Feb. 6, 1995 [DE] Germany ..... 195 20 390.9

[51] Int. Cl.[6] ..... A47C 7/02

[52] U.S. Cl. ..... 297/452.2; 297/451.13

[58] Field of Search ..... 297/DIG. 2, 452.2, 297/452.18, 440.24, 440.1, 440.16, 440.22, 451.11, 451.13, 445.1, 446.2, 447.4, 449.1; 108/42, 161, 153; 312/352, 257.1

[56] References Cited

U.S. PATENT DOCUMENTS 1,932,794 10/1933 McArthur, Jr. ..... 297/445.1 X
2,818,107 12/1957 Thaden ..... 297/451.12 X
3,672,723 6/1972 Decursu et al. ..... 297/440.24
3,698,150 10/1972 Anderson ..... 297/451.11 X
3,784,254 1/1974 Longato ..... 297/451.11
3,822,079 7/1974 Probber ..... 297/440.24 X
3,873,154 3/1975 Baker, Jr. ..... 297/451.11 X
4,657,302 4/1987 Snyder ..... 297/440.24 X
4,784,436 11/1988 Sutherland ..... 297/440.24
4,787,319 11/1988 Dupraz ..... 297/440.24 X

*Primary Examiner*—Milton Nelson, Jr.
*Attorney, Agent, or Firm*—Banner & Witcoff, Ltd.

[57] ABSTRACT

A one-piece furniture frame of plastic including a support structure and legs, wherein the legs are connected to a support structure through the intermediary of tubular receptacles. The tubular receptacles extend as far as the floor and form the legs, into each of which legs is inserted at least one fitted supporting rod.

5 Claims, 2 Drawing Sheets

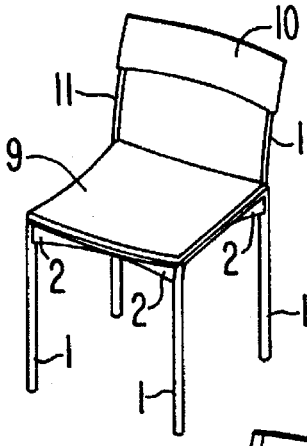
FIG. 3
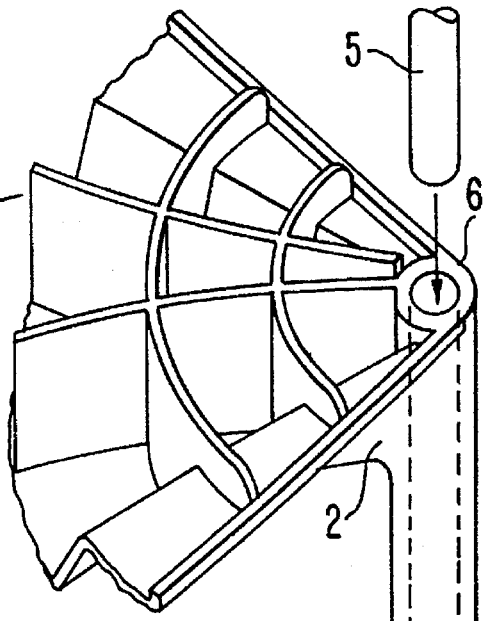
FIG. 1
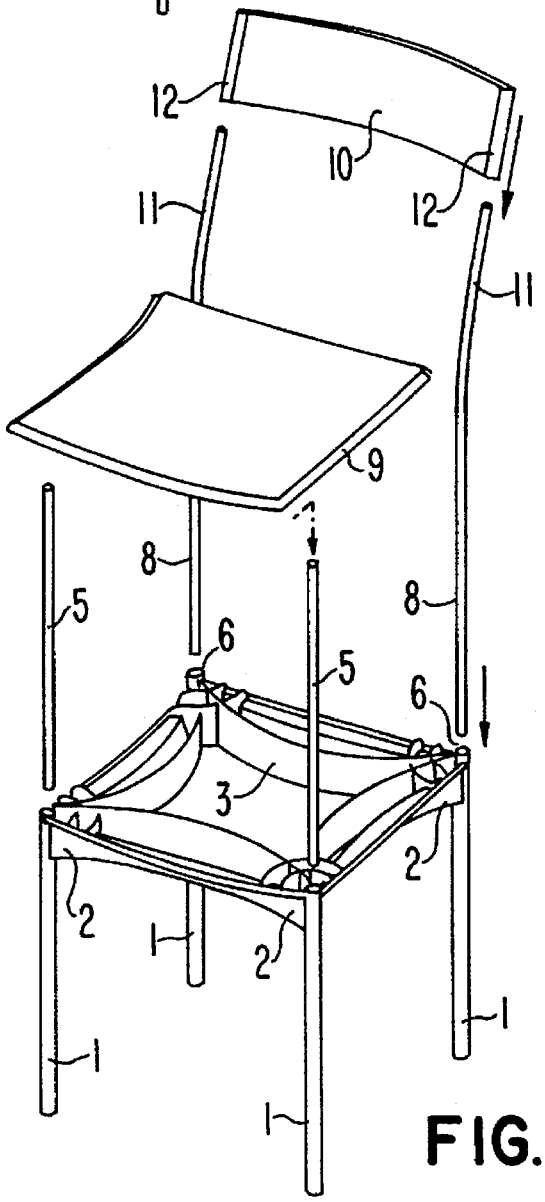
FIG. 2
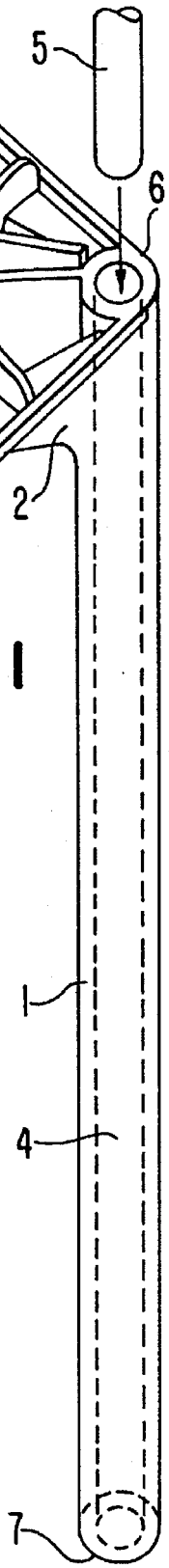

ONE-PIECE FURNITURE FRAME

BACKGROUND AND SUMMARY OF THE INVENTION

The invention relates to a one-piece furniture frame of plastic with legs, said legs being connected to a plate through the intermediary of tubular receptacles.

Such a design is on the market and is shown in the "STRAX" brochure of the firm Casala-(Casala Möbel-Werke GmbH, Neu-Ulm).

In said design, the relatively short tubular receptacle, which extends over the region of the plate and the holder thereof, forms a critical point, because the stability of the furniture frame—particularly if the furniture in question is for sitting on—is dependent on the tubular receptacle. Furthermore, the construction of the leg, enclosed by the tubular receptacle, is complex, because, viewed from the leg, it only partially fills the tubular receptacle and the side facing away from the leg is covered by a plug, for which plug there is a special connection to the leg situated inside the tubular receptacle. This diminishes the stability of the totality of parts embraced by the tubular receptacle and, moreover, the design-related outlay on said connection results in correspondingly high material costs and manufacturing costs.

The object of the invention is to improve the initially described design with regard to stability and to reduce the technical complexity thereof. The object of the invention is achieved in that the tubular receptacles extend as far as the floor and form the legs, into each of which legs is inserted at least one fitted supporting rod.

Owing to the fact that, in contrast to the known design, the tubular receptacles are extended as far as the floor—through which extension the tubular receptacles assume the function of the legs—there results the visually attractive possibility of the insertion of at least one supporting rod into each leg, said supporting rod being able to extend over the entire length of the tubular receptacle/leg and therefore being able to exert its full stability-enhancing effect over the entire length of the leg. Alternatively, however, it is also of course possible to make the supporting rod shorter, with the result that it does not extend completely to the floor end of the respective leg. This depends on the stability of the plastic used for the furniture frame.

The supporting rod is preferably a metal rod. However, it is, of course, also possible to employ hard wood or a plastic especially suitable for the purpose. The appearance of the supporting rod is of no consequence, since it is completely surrounded by the tubular receptacle, with the result that, in this respect, the visual attractiveness of the furniture frame in question is determined exclusively by the appearance of the tubular receptacle. The supporting rod may also consist of a plurality of adjoining pieces.

Particularly in cases where the furniture frame is in the form of a piece of furniture for sitting on, it is advantageous for the supporting rods, inserted into a plurality of tubular receptacles, to be interconnected. In this case, a length of the supporting rods projecting from the tubular receptacle is used as a holder for the connection of two adjacent supporting rods, said connection then being available for use as a backrest. The backrest may be a separate plastic part provided with its own short tubular receptacles, into which the ends of the supporting rods are then inserted. Alternatively, however, it is also possible to interconnect the supporting rods themselves, for which purpose, on the connection side, where they protrude from the tubular receptacles, the supporting rods are each bent towards the other supporting rod. In the case of the connection of two adjacent supporting rods, it is advantageous to employ a U-shaped design of the two supporting rods with their connection.

Such connections may advantageously be used as armrests. Furthermore, such connections may also serve the respective furniture frame—particularly when the furniture is for sitting on—as an elongated floor runner extending between two supporting rods. Such runners, connecting two adjacent supporting rods, may advantageously be used particularly when the furniture in question is a chair that frequently has to be pushed backwards and forwards.

BRIEF DESCRIPTION OF THE DRAWINGS

Specimen embodiments of the invention are shown in the drawings, in which:

FIG. 1 shows a detail, restricted to one leg, of a furniture frame with supporting rod to be inserted;

FIG. 2 shows a piece of furniture for sitting on, with the furniture frame, the supporting rods to be inserted, the seat plate and the backrest;

FIG. 3 shows the finished design of the piece of furniture for sitting on according to FIG. 2;

DETAILED DESCRIPTION OF THE PREFERRED EMBODIMENTS

Figure 4:
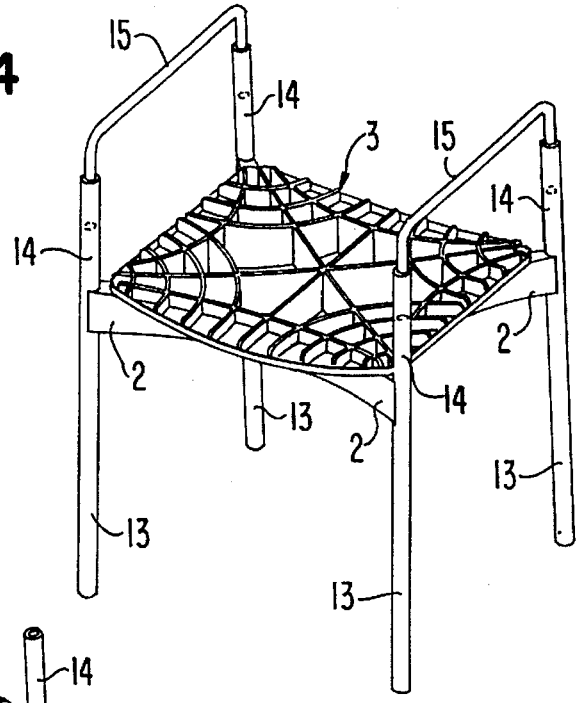
FIG. 4 shows the furniture frame for a stool with armrests.

FIG. 1 shows a detail of a one-piece furniture frame of plastic, said detail relating merely to one leg and to the structure (attached thereto) for a plate. The drawing shows the tubular receptacle 1, said tubular receptacle 1 forming one leg and merging, via integral carrying parts 2, into the supporting structure 3 for a plate (not shown). Such a supporting structure is known. The tubular receptacle 1 extends over the entire height of the supporting structure 3 and extends as far as the floor on which the furniture frame is to be set down. In order to afford the required stability to the tubular receptacle (formed from the same plastic together with the supporting structure 3), particularly in the region of the carrying parts 2, the supporting rod 5 is provided for insertion into the interior 4 of the tubular receptacle, said supporting rod 5 being shown in the drawing above the tubular receptacle 1 prior to its insertion. The supporting rod 5 is inserted in the direction of the arrow shown until the supporting rod 5 fills essentially the entire length of the tubular receptacle 1. The supporting rod 5 may be of such a length that it completely fills the tubular receptacle 1 from the upper end 6 thereof to the lower end 7 thereof, this transmitting to the tubular receptacle 1 the maximum possible stability afforded by the supporting rod 5. Alternatively, however, it is also of course possible for the supporting rod 5 to be terminated at something of a distance from the lower end 7, particularly if, for reasons of visual attractiveness or prevention of damage to the floor, a plug is to be inserted into the lower end 7.

The supporting rod 5 shown in FIG. 1 consists of base material, the diameter of which is such that, when being inserted into the tubular receptacle, the supporting rod fits snugly therein. This may be accomplished, for example, in that the plastic forming the material of the tubular receptacle 1 is heated, whereupon the supporting rod 5 is inserted, the material of the tubular receptacle 1 then drawing itself tightly around the supporting rod 5 as said material cools down. The supporting rod 5 consists preferably of metal. Alternatively, however, it is also possible to employ therefor a hard wood or a suitably hard plastic. Equally, the supporting rod 5 may consist of solid material or of tubular material.

FIG. 2 shows the individual parts of a piece of furniture for sitting on, the drawing being in the form of a so-called exploded drawing, in which the individual parts thereof are shown separately prior to assembly. As can be seen, the supporting rods 5 and 8 are provided for the four tubular receptacles 1, of which supporting rods 5 and 8 the supporting rods 5 are of such length (as explained with reference to FIG. 1) that they extend over the entire length of the tubular receptacles. The supporting rods 8 are supporting rods that protrude from the upper ends 6 of the two rear tubular receptacles 1 and, with their protruding lengths 11, serve as a holder for a backrest 10 (see also FIG. 3).

The insertion of the supporting rods 5 and 8 into the tubular receptacles 1 in the direction of the arrow shown then results in the furniture frame, onto the supporting structure 3 of which the plate 9 is laid and, if appropriate, glued. At its lateral ends, the backrest 10 comprises the tubular receptacles 12, into which the protruding lengths 11 of the supporting rods 8 are inserted.

FIG. 3 shows the finished design of the piece of furniture for sitting on as indicated in FIG. 2, said drawing showing the protruding lengths 11 with the backrest 10 pushed onto them.

FIG. 4 shows a furniture frame provided for the design of a stool, the drawing showing tubular receptacles 13 protruding beyond the supporting structure 3 and forming the extensions 14 above the supporting structure 3. The extensions 14 each form a continuous tube with the tubular receptacles 13. In this case, said extensions 14 are used in order to accommodate armrests 15 in the form of U-shaped brackets, said armrests 15 continuing into the supporting rods inserted into the tubular receptacles 13. Accordingly, the armrests 15 consist of the supporting rods, said supporting rods (not visible in FIG. 4) filling the tubular receptacles 13 and protruding from the extensions 14 and each describing a bend directed towards an adjacent extension, this giving rise to the aforementioned U-shaped design. This is a particularly stable construction, since the supporting rods of two adjacent tubular receptacles 13 are interconnected in one piece through the intermediary of the respective arm rest 15.

Figure 5:
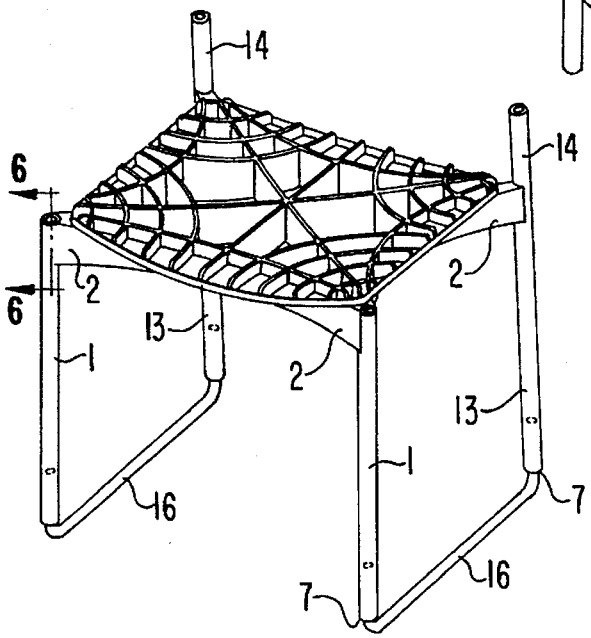
FIG. 5 shows the furniture frame for a piece of furniture for sitting on with runners.

FIG. 5 shows a variant of the design according to FIG. 4, wherein only the rear tubular receptacles 13 become the extensions 14. Said extensions 14 may then be used, if applicable through the intermediary of a U-shaped connection, for the attachment of a backrest. Inserted in this case into the lower ends 7 of the supporting rods 1 and 13 are the U-shaped runners 16, with which the particular piece of furniture is supported with respect to the floor. The runners 16 may, similarly to the design shown in FIG. 4, continue into the invisible supporting rods, said supporting rods being inserted into the tubular receptacles 1 and 13. Alternatively, however, it is also of course possible to provide the runners 16 just with short stumps projecting into the ends 7, for which purpose the supporting rods must be suitably shortened in design.

Figure 6:
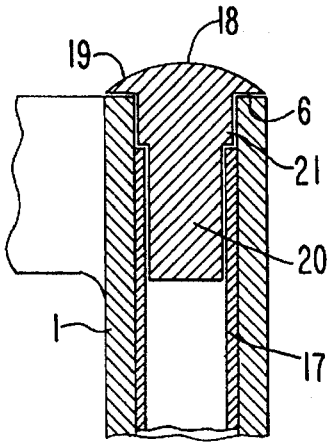
FIG. 6 shows the design of the upper end of a supporting rod.

FIG. 6 shows a design of the upper end of a supporting rod 17, said supporting rod 17 being designed to accommodate a terminating plug, said terminating plug providing an attractive termination to the corresponding end of the tubular receptacle 1. For this reason, the supporting rod 17 ends a short distance above the upper end 6 of the tubular receptacle 1 and leaves space for the accommodation of the terminating plug 18, which, with its edge 19, closes off the upper end 6 of the tubular receptacle 1. In order to provide the terminating plug 18 with a secure seating both in the tubular receptacle 1 and also in the (in this case) tubular supporting rod 17, the terminating plug 18 has an enlargement 21, said enlargement 21 being of greater diameter than the stem 20. The stem 20 is snugly seated in the supporting rod 17. In FIG. 6, the parts of the terminating plug 18 that are embraced by the upper end 6 of the tubular receptacle 1 are shown as being at a distance from the tubular receptacle 1; this is done here only for reasons of clarity of the representation. In reality, the parts in question are essentially in snug contact with each other.

What is claimed is:

1. Furniture comprising a one-piece frame of plastic, said frame including a supporting structure and a plurality of tubular legs supporting said supporting structure, each said tubular leg having an inner surface, and at least one generally rigid supporting rod matingly fit within each tubular leg and engaging said inner surface of said leg substantially throughout the length of said leg.

2. Furniture according to claim 1, wherein certain of said supporting rods inserted into said tubular legs are interconnected.

3. Furniture according to claim 2, wherein the interconnected supporting rods protrude from the respective legs on a side on which the supporting rods are connected and are each bent toward the other supporting rod.

4. Furniture according to claim 3, wherein supporting rods are connected by a connection between adjacent supporting rods which serves as an armrest.

5. Furniture according to claim 3, wherein the supporting rods are connected by a connection between adjacent supporting rods which serves as a backrest.

* * * * *